US009156654B2

(12) United States Patent
Katsura

(10) Patent No.: US 9,156,654 B2
(45) Date of Patent: Oct. 13, 2015

(54) ELEVATOR MONITORING DEVICE

(75) Inventor: Masaomi Katsura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 612 days.

(21) Appl. No.: 13/634,748

(22) PCT Filed: Jun. 30, 2010

(86) PCT No.: PCT/JP2010/061117
§ 371 (c)(1),
(2), (4) Date: Sep. 13, 2012

(87) PCT Pub. No.: WO2012/001778
PCT Pub. Date: Jan. 5, 2012

(65) Prior Publication Data

US 2013/0025978 A1 Jan. 31, 2013

(51) Int. Cl.
*B66B 3/02* (2006.01)
*B66B 3/00* (2006.01)
*B66B 5/00* (2006.01)

(52) U.S. Cl.
CPC . *B66B 3/02* (2013.01); *B66B 3/002* (2013.01); *B66B 5/0018* (2013.01)

(58) Field of Classification Search
CPC ..... B66B 3/02; B66B 3/002; B66B 5/0018
USPC ..... 187/247, 380–388, 391–394, 396–399
See application file for complete search history.

(56) References Cited

U.S. PATENT DOCUMENTS 1,896,784 A * 2/1933 Norton et al. ..... 187/394
3,740,709 A * 6/1973 Savino ..... 187/391

(Continued)

FOREIGN PATENT DOCUMENTS

JP 58 78978 5/1983
JP 2 221084 9/1990

(Continued)

OTHER PUBLICATIONS

English Translation of the International Preliminary Report on Patentability and Written Opinion issued Feb. 21, 2013 in PCT/JP2010/061117.
International Search Report Issued Aug. 17, 2010 in PCT/JP10/61117 Filed Jun. 30, 2010.

*Primary Examiner* — Anthony Salata
(74) *Attorney, Agent, or Firm* — Oblon, McClelland, Maier & Neustadt, L.L.P.

(57) ABSTRACT

An elevator monitoring device enables positional relationship of elevator cars to be grasped. The elevator monitoring device includes a receiving section which receives position information of each car, and an indication control section which causes a plurality of car-present-floor symbols representing floors corresponding to positions of the cars to be indicated in line in the order corresponding to the positional relationship of the cars and causes car symbols representing the cars to be indicated by being correlated to the car-present-floor symbols. The indication control section compresses indication areas assigned to inter-floor floors corresponding to positions of the cars between the plurality of car-present-floor symbols, in the arrangement direction of the plurality of car-present-floor symbols compared to the case where a plurality of symbols representing each of the inter-floor floors corresponding to positions of the cars are indicated in line.

7 Claims, 11 Drawing Sheets

(56) References Cited

U.S. PATENT DOCUMENTS

| | | | | |
|---|---|---|---|---|
| 4,852,696 | A * | 8/1989 | Fukuda et al. | 187/392 |
| 5,886,696 | A * | 3/1999 | Kakko et al. | 715/787 |
| 6,550,587 | B1 * | 4/2003 | Yuasa et al. | 187/394 |
| 7,147,085 | B2 * | 12/2006 | Sekimoto | 187/399 |
| 8,348,018 | B2 * | 1/2013 | Kostka | 187/249 |
| 8,403,113 | B2 * | 3/2013 | Takeuchi | 187/396 |
| 2006/0207836 | A1 * | 9/2006 | Takeuchi | 187/391 |
| 2011/0147136 | A1 * | 6/2011 | Kuroda | 187/394 |
| 2012/0181118 | A1 * | 7/2012 | Choi et al. | 187/393 |

FOREIGN PATENT DOCUMENTS

| | | |
|---|---|---|
| JP | 3 147690 | 6/1991 |
| JP | 3 211180 | 9/1991 |
| JP | 7 80654 | 8/1995 |
| JP | 8 231149 | 9/1996 |
| JP | 2003 246559 | 9/2003 |

* cited by examiner

ELEVATOR MONITORING DEVICE

TECHNICAL FIELD

The present invention relates to an elevator monitoring device which causes the position of a car of an elevator to be indicated.

BACKGROUND ART

There is proposed an elevator monitoring device which indicates the car position, status and the like of an elevator as one of elevator monitoring devices. These indications enable the status of the elevator to be monitored (refer to Patent Literature 1 to Patent Literature 3, for example).

CITATION LIST

Patent Literature

Patent Literature 1: Japanese Patent Publication No. 7-80654

Patent Literature 2: Japanese Patent Laid-Open No. 3-147690

Patent Literature 3: Japanese Patent Laid-Open No. 8-231149

The elevator monitoring device described in Patent Literature 1 causes a shaft screen (an elevation view) to be indicated. On this shaft screen, symbols representing the service floors of an elevator are indicated in line. A symbol representing the car is indicated in any of these symbols in a correlated manner. As a result of this, it is possible to visually make sure at which floor of the building the car is present.

SUMMARY OF INVENTION

Technical Problem

However, in the elevator monitoring device described in Patent Literature 1, in the case where there are many elevator service floors, it is necessary to indicate the whole shaft screen in a scaled-down manner or indicate a shaft screen in a scrolled manner. For this reason, it becomes difficult to grasp the positional relationship of elevator cars on one screen.

The present invention was made to solve the problem described above and the object of the invention is to provide an elevator monitoring device which enables the positional relationship of elevator cars to be grasped without indicating the whole shaft screen in a scaled-down manner or indicating a shaft screen in a scrolled manner.

Means for Solving the Problems

An elevator monitoring device of the present invention includes a receiving section which receives position information of each car of an elevator and an indication control section which causes a plurality of car-present-floor symbols representing floors corresponding to positions of each of the cars to be indicated in line in an order corresponding to a positional relationship of the cars and causes car symbols representing each of the cars to be indicated by being correlated to each of the car-present-floor symbols, wherein the indication control section compresses indication areas which are assigned to inter-floor floors corresponding to the positions of each of the cars between the plurality of car-present-floor symbols, in a direction of arrangement of the plurality of car-present-floor symbols compared to the case where a plurality of symbols representing each of the inter-floor floors corresponding to positions of each of the cars are indicated in line.

Advantageous Effect of Invention

According to the present invention, it is possible to grasp the positional relationship of elevator cars without indicating the whole shaft screen in a scaled-down manner or indicating a shaft screen in a scrolled manner.

DESCRIPTION OF EMBODIMENTS

Embodiments for carrying out the present invention will be described in accordance with the accompanying drawings. Incidentally, in each of the drawings, the same numerals refer to the same or corresponding parts and overlaps of description of these parts are appropriately simplified or omitted.

Embodiment 1

Figure 1:
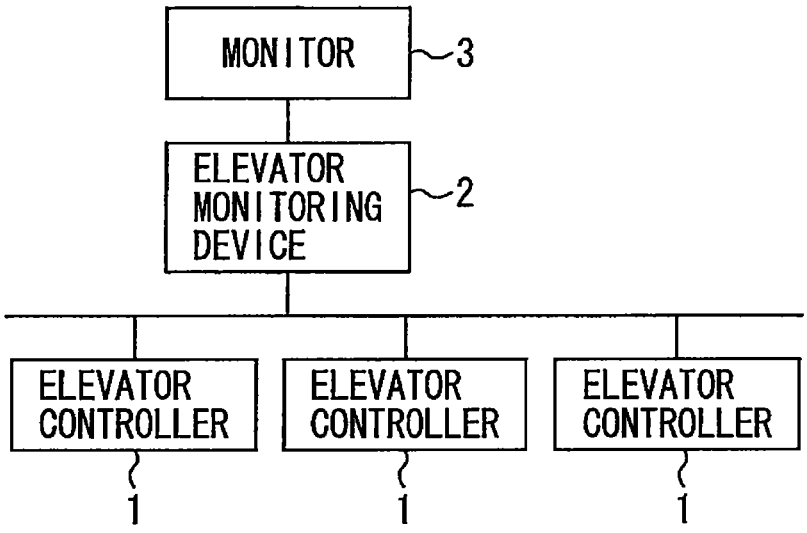
FIG. 1 is a block diagram of the elevator in which an elevator monitoring device in Embodiment 1 of the present invention is used.

FIG. 1 is a block diagram of the elevator in which an elevator monitoring device in Embodiment 1 of the present invention is used.

In FIG. 1, reference numeral 1 denotes a plurality of elevator controllers. These elevator controllers 1 have the function of controlling each of a plurality of elevators installed in a high-rise building. These elevator controllers 1 are connected to an elevator monitoring device 2.

This elevator monitoring device 2 has the function of receiving data on the car position, status of a door and the like of each elevator from each of the elevator controllers 1. This elevator monitoring device 2 has the function of monitoring the whole bank of elevators on the basis of information on the car position and status of each elevator. A monitor 3 is connected to this elevator monitoring device 2. This monitor 3 has the function of indicating a monitoring screen of an elevator.

Next, the elevator monitoring device 2 will be described with the aid of FIG. 2.

Figure 2:
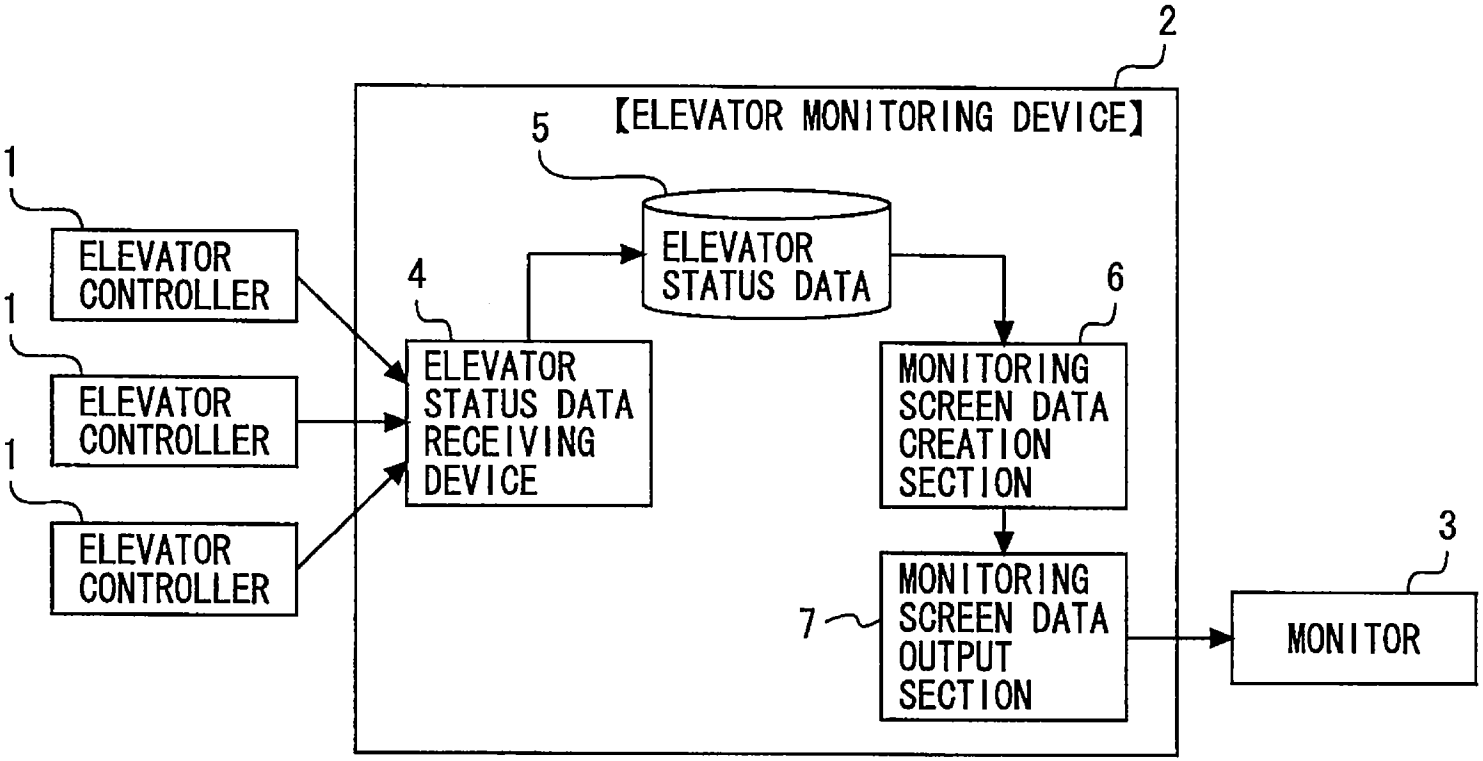
FIG. 2 is a block diagram of the monitoring device of the elevator in Embodiment 1 of the present invention.

FIG. 2 is a block diagram of the monitoring device of the elevator in Embodiment 1 of the present invention.

The elevator monitoring device 2 is of a PC (personal computer) type. This elevator monitoring device 2 is provided with an elevator status data receiving section 4, a memory section 5, a monitoring screen data creation section 6, and a monitoring screen data output section 7.

The elevator status data receiving section 4 has the function of receiving data on the car position and status of each elevator from the elevator controllers 1. The memory section 5 has the function of storing data on the car position and status of each elevator received by the elevator status data receiving section 4.

The monitoring screen data creation section 6 and a monitoring screen data output section 7 function as an indication control section which controls the indication of the monitor 3. Specifically, the monitoring screen data creation section 6 has the function of creating monitoring screen data on the basis of the data on the car position and status of each elevator stored in the memory section 5. The monitoring screen data output section 7 has the function of outputting monitoring screen data created in the monitoring screen data creation section 6 to the monitor 3.

Next, indications of the monitor 3 based on monitoring screen data will be described with the aid of FIGS. 3 and 4.

Figure 3:
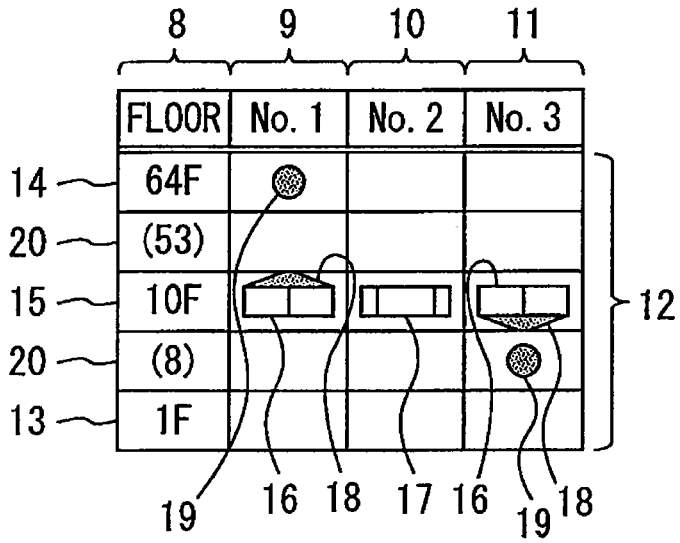
FIG. 3 is a diagram to explain the indications of the monitor shown when the elevator monitoring device in embodiment 1 of the present invention is used.
Figure 4:
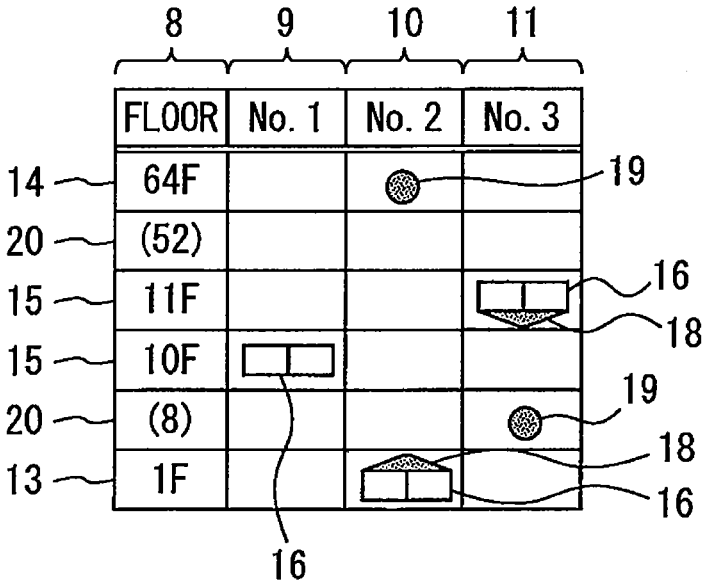
FIG. 4 is a diagram to explain the indications of the monitor shown when the elevator monitoring device in embodiment 1 of the present invention is used.

FIGS. 3 and 4 are diagrams to explain the indications of the monitor shown when the elevator monitoring device in embodiment 1 of the present invention is used.

As shown in FIG. 3, a shaft screen (an elevation view) in which shafts are schematically depicted is indicated on the monitor 3. Specifically, a floor indication area 8 is formed in the upper left part of the screen of the monitor 3. Adjacent to the right side of this floor indication area 8, a No. 1 elevator name indication area 9 is formed. Adjacent to the right side of this elevator name indication area 9, a No. 2 elevator name indication area 10 is formed. Adjacent to the right side of this elevator name indication area 10, a No. 3 elevator name indication area 11 is formed. And a matrix area 12 is formed adjacent to the underside of the floor indication area 8 and each of the elevator name indication areas 9 to 11.

"Floor" is indicated in the floor indication area 8. In the elevator name indication areas 9 to 11, "No. 1," "No. 2," and "No. 3" are respectively indicated as the names of the elevators. In the matrix area 12 below the floor indication area 8, symbols representing each floor are indicated in line in the vertical direction in the order which corresponds to the positional relationship of each floor in the vertical direction.

A terminal-floor symbol 13 is indicated below the floor indication area 8 and in the bottom part of the matrix area 12. This terminal-floor symbol 13 represents a bottom floor. Specifically, "1F" is indicated as the terminal-floor symbol 13. On the other hand, a terminal-floor symbol 14 is indicated below the floor indication area 8 and in the top part of the matrix area 12. This terminal-floor symbol 14 represents a top floor. Specifically, "64F" is indicated as the terminal-floor symbol 14.

A car-present-floor symbol 15 is indicated between the terminal-floor symbol 13 and the terminal-floor symbol 14. This car-present-floor symbol 15 represents a floor corresponding to the position of each car. Specifically, "10F" is indicated as the car-present-floor symbol 15 corresponding to the No. 1 to No. 3 cars.

Car symbols are indicated in the matrix area 12 in the horizontal direction of the car-present-floor symbol 15 and below each of the elevator name indication areas 9 to 11. These car symbols represent each car. Specifically, a car symbol representing the No. 1 car is indicated in the horizontal direction of "10F" and below "No. 1." And a car symbol representing the No. 2 car is indicated in the horizontal direction of "10F" and below "No. 2." Furthermore, a car symbol representing the No. 3 car is indicated in the horizontal direction of "10F" and below "No. 3."

A car whose door is closed is indicated by a car symbol 16. This car symbol 16 is a horizontally-long rectangle with a vertical line in the middle thereof. This vertical line represents the status of a closed car door. On the other hand, a car whose door is open is indicated by a car symbol 17. This car symbol 17 is a horizontally-long rectangle with vertical lines in the inner side of both sides. These vertical lines represent the status of an open car door.

The travel direction of a car is represented by a travel direction symbol 18. This travel direction symbol 18 is indicated adjacent to the upper part or lower part of the car symbol 16. In the case where the travel direction symbol 18 is adjacent to the upper part of the car symbol 16, the travel direction symbol 18 becomes a triangle having an apex on the upper side. The direction of this triangle represents that the car is ascending. On the other hand, in the case where the travel direction symbol 18 is adjacent to the lower part of the car symbol 16, the travel direction symbol 18 becomes a triangle having an apex on the lower side. The direction of this triangle represents that the car is descending.

In the case where a car call occurs to each elevator, a car call symbol 19 is indicated below the elevator name indication areas 9 to 11. For example, a top-floor car call occurs to the No. 1 elevator, as shown in FIG. 3, a circular car call symbol 19 is indicated in the horizontal direction of "64F" and below "No. 1."

In this embodiment, inter-floor floors corresponding to each car position are aggregated as one floor. Specifically, one intermediate-floor indication area is assigned to inter-floor floors corresponding to each car position between the car-present-floor symbols 15. This intermediate-floor indication area is compressed in the vertical direction compared to the area expected in the case where a plurality of symbols representing each of the inter-floor floors corresponding to each car position are indicated in line.

Similarly, between the terminal-floor symbol 13 and the car-present-floor symbol 15 representing a floor corresponding to a car nearest to the bottommost floor side, one intermediate-floor indication area is assigned also to floors between a bottom floor and a floor corresponding to a car nearest to the bottommost floor side. Furthermore, between the car-present-floor symbol 15 representing a floor corresponding to a car nearest to the topmost floor side and the terminal-floor symbol 14, one intermediate-floor indication area is assigned also to floors between a floor corresponding to a car nearest to the topmost floor side and a top floor.

Furthermore, one area is also assigned in the horizontal direction of these intermediate-floor indication areas and below the elevator name indication areas 9 to 11, to each of these areas.

In the intermediate-floor indication areas, the number of floors present between floors represented by the car-present-floor symbols 15 indicated in upper and lower areas and the like is indicated. On this occasion, the number of floors is bracketed. The indications in the intermediate-floor indication areas are distinguished by the brackets from the terminal-floor symbols 13, 14 and the car-present-floor symbol 15.

In this embodiment, matrix areas 12 increase or decrease in the vertical direction according to changes in the position of each car. Specifically, the indication of the car-present-floor symbol 15 changes in real time according to a change in the position of each car. As a result of this, also the intermediate-floor indication areas change in real time. As a result of this, also the indications in the intermediate-floor indication areas change.

For example, in FIG. 3, all of the No. 1 to No. 3 cars are present at the 10th floor. For this reason, there is no inter-floor floor which corresponds to each car position. In this case, an intermediate-floor indication area is not assigned.

On the other hand, 8 floors of the 2nd floor to the 9th floor are present between the bottom floor and the 10th floor at which the No. 1 to No. 3 cars are present. For this reason, an intermediate-floor indication area 20 is assigned between "1F" and "10F." In this intermediate-floor indication area 20, "(8)" is indicated.

Between the 10th floor at which the No. 1 to No. 3 cars are present and the top floor, 53 floors of the 11th floor to the 63rd floor are present. For this reason, an intermediate-floor indication area 20 is assigned also between "10F" and "64F." In this intermediate-floor indication area 20, "(53)" is indicated.

In contrast to this, in FIG. 4, the No. 2 car is present at the 1st floor. The 1st floor is the bottom floor. Originally, the bottom floor is indicated by the terminal-floor symbol 13. For this reason, in this respect, the number of areas in which the car-present-floor symbol 15 is indicated does not increase compared to the case of FIG. 3.

However, the No. 3 car is present at the 11th floor. In FIG. 3, the area in which the car-present-floor symbol 15 representing the 11th floor is indicated is not formed. For this reason, one area is added just above "10F." In this area "11F" is indicated. That is, the number of areas in which the car-present-floor symbol 15 is indicated increases by one compared to the case shown in FIG. 3.

On this occasion, the No. 3 car becomes a car nearest to the topmost floor side. Between the 11th floor at which the No. 3 car is present and the top floor, 52 floors of the 12th floor to the 63rd floor are present. For this reason, in the intermediate-floor indication area 20 between "11F" and "64F," "(52)" is indicated. That is, the numeral indicated in the intermediate-floor indication area 20 is smaller by one than in FIG. 3.

Incidentally, in this embodiment, in the case where even only one car call occurs for the floor to which the intermediate-floor indication area 20 is assigned, a car call symbol 19 is indicated in the horizontal direction of the intermediate-floor indication area 20. For examples, FIGS. 3 and 4 show the status in which a car call from the 3rd floor occurs to the No. 3 elevator. In this case, the car call symbol 19 is indicated in the horizontal direction of the intermediate-floor indication area 20 between "1F" and "10F."

Next, with the aid of FIGS. 5 to 10 a description will be given of the case where the No. 1 car responds to a car call when the No. 1 to No. 3 cars are at the same floor.

FIGS. 5 to 10 are diagrams to explain changes in a monitor screen occurring when the elevator monitoring device in Embodiment 1 of the present invention is used.

Figure 5:
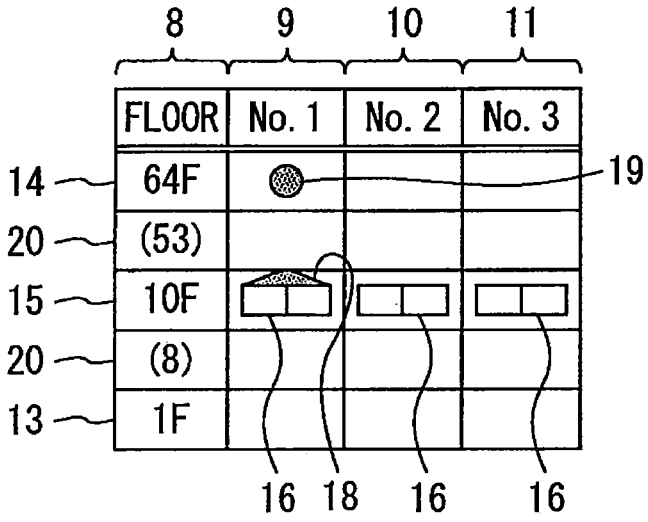
FIG. 5 is a diagram to explain changes in a monitor screen occurring when the elevator monitoring device in Embodiment 1 of the present invention is used.

In FIG. 5, all of the No. 1 to No. 3 cars are present at the 10th floor. A consideration is given to the case where in this state the No. 1 car responds to a car call from the 64th floor. In this case, in the same way as in FIG. 3, "(8)" is indicated in the intermediate-floor indication area 20 between "1F" and "10F." Furthermore, "(53)" is indicated in the intermediate-floor indication area 20 between "10F" and "64F."

Figure 6:
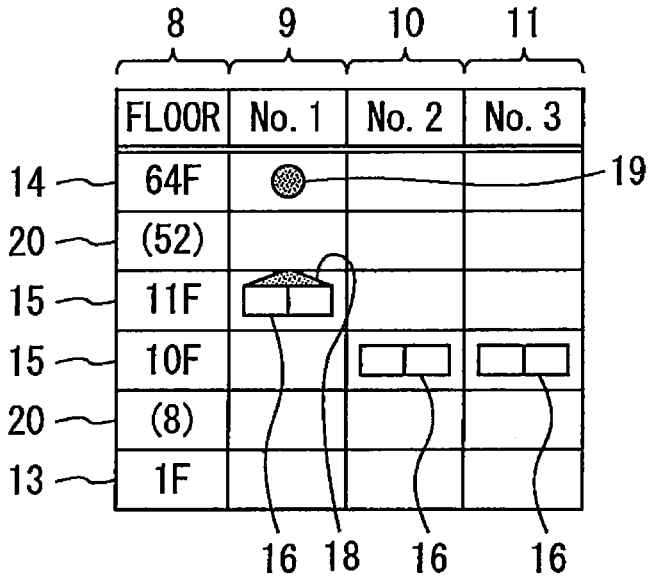
FIG. 6 is a diagram to explain changes in a monitor screen occurring when the elevator monitoring device in Embodiment 1 of the present invention is used.

After that, as shown in FIG. 6, when the No. 1 car ascends to the 11th floor, one area is assigned just above "10F." In this area "11F" is indicated. The car symbol 16 representing the No. 1 car is indicated in the horizontal direction of this "11F" and below "No. 1." At this time, no floor is present between the floor at which No. 2 and No. 3 cars are present and the floor at which the No. 1 car is present. For this reason, the intermediate-floor indication area 20 is not assigned between "10F" and "11F."

On this occasion, the No. 1 car becomes a car nearest to the topmost floor side. The number of floors between the floor at which this No. 1 car is present and the topmost floor decreases from 53 to 52. For this reason, the indication of the intermediate-floor indication area 20 between "11F" and "64F" changes from "(53)" to "(52)."

Figure 7:
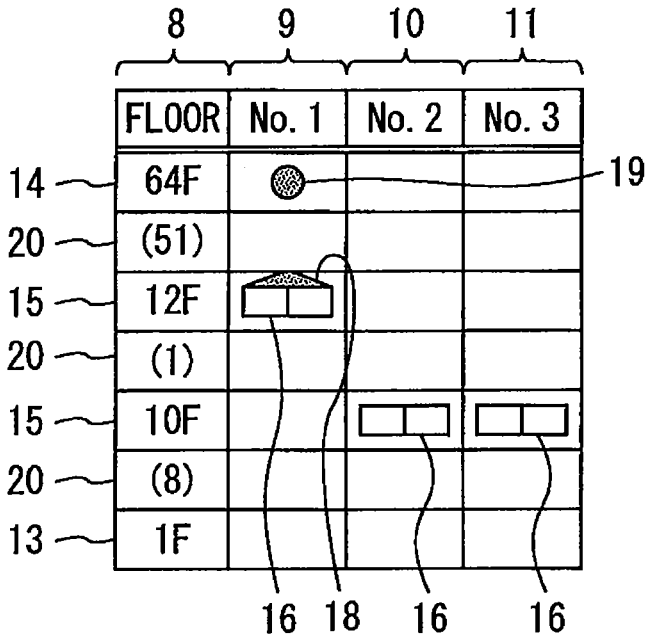
FIG. 7 is a diagram to explain changes in a monitor screen occurring when the elevator monitoring device in Embodiment 1 of the present invention is used.

After that, as shown in FIG. 7, when the No. 1 car ascends to the 12th floor, the car-present-floor symbol 15 below the floor indication area 8 and in the horizontal direction of the car symbol 16 representing the No. 1 car changes from "11F" to "12F." At this time, one floor of the 11th floor is present between the floor at which the No. 2 and No. 3 cars are present and the floor at which the No. 1 car is present. For this reason, an intermediate-floor indication area 20 is assigned between "(10F)" and "(12F)." In this intermediate-floor indication areas 20 "(1)" is indicated.

On this occasion, the number of floors between the floor at which the No. 1 car is present and the topmost floor decreases from 52 to 51. For this reason, the indication of the intermediate-floor indication area 20 between "12F" and "64F" changes from "(52)" to "(51)."

Figure 8:
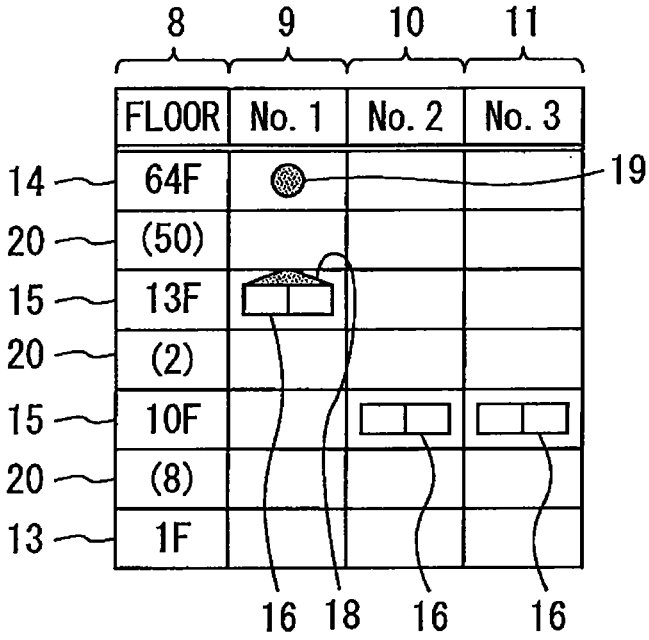
FIG. 8 is a diagram to explain changes in a monitor screen occurring when the elevator monitoring device in Embodiment 1 of the present invention is used.

After that, as shown in FIG. 8, when the No. 1 car ascends to the 13rd floor, the car-present-floor symbol 15 below the floor indication area 8 and in the horizontal direction of the car symbol 16 representing the No. 1 car changes from "12F" to "13F." At this time, the number of floors between the floor at which the No. 2 and No. 3 cars are present and the floor at which the No. 1 car is present increases from 1 to 2. For this reason, the indication of the intermediate-floor indication area 20 between "10F" and "13F" changes from "(1)" to "(2)."

On this occasion, the number of floors between the floor at which the No. 1 car is present and the topmost floor decreases from 51 to 50. For this reason, the indication of the intermediate-floor indication area 20 between "13F" and "64F" changes from "(51)" to "(50)."

After that, each time the No. 1 car ascends by one floor, the car-present-floor symbol 15 below the floor indication area 8 and in the horizontal direction of the car symbol 16 representing the No. 1 car changes to a symbol representing a corresponding floor. As a result of this, between the car-present-floor symbol 15 representing the No. 2 and No. 3 cars and the car-present-floor symbol 15 representing the No. 1 car, the number indicated in the intermediate-floor indication area 20 increases by one. At the same time, between the car-present-floor symbol 15 representing the No. 1 car and the terminal-floor symbol 14, the numeral indicated in the intermediate-floor indication area 20 decreases by one.

Figure 9:
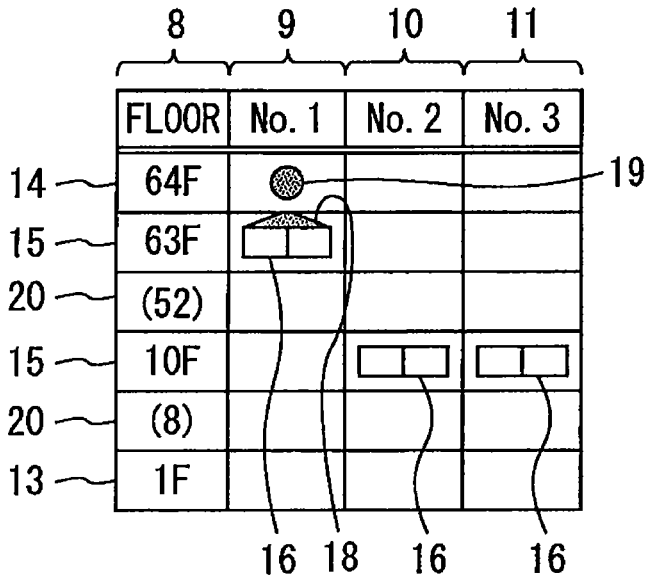
FIG. 9 is a diagram to explain changes in a monitor screen occurring when the elevator monitoring device in Embodiment 1 of the present invention is used.

After that, as shown in FIG. 9, when the No. 1 car ascends to the 63rd floor, the car-present-floor symbol 15 below the floor indication area 8 and in the horizontal direction of the car symbol 16 representing the No. 1 car changes to "63F." At this time, 52 floors from the 11th floor to the 62nd floor are present between the floor at which the No. 2 and No. 3 cars are present and the floor at which the No. 1 car is present. For this reason, the indication of the intermediate-floor indication area 20 between "10F" and "63F" changes to "(52)."

On this occasion, there is no floor between the floor at which the No. 1 car is present and the top floor. For this reason, the intermediate-floor indication area 20 is erased from between "63F" and "64F."

Figure 10:
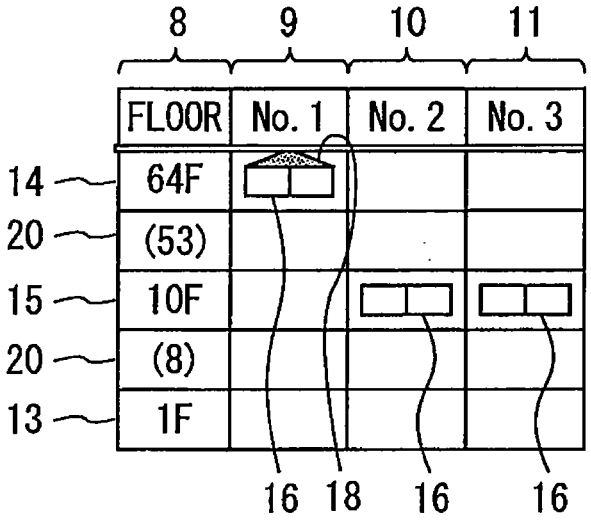
FIG. 10 is a diagram to explain changes in a monitor screen occurring when the elevator monitoring device in Embodiment 1 of the present invention is used.

After that, as shown in FIG. 10, when the No. 1 car arrives at the 64th floor, the floor at which the No. 1 car is present and the top floor coincide with each other. For this reason, the floor at which the No. 1 car is present and the top floor are indicated as "64F" in one area.

On this occasion, the number of floors between the floor at which the No. 2 and No. 3 cars are present and the floor at which the No. 1 car is present increases from 52 to 53. For this reason, the indication of the intermediate-floor indication area 20 between "10F" and "64F" changes from "(52)" to "(53)."

Next, with the aid of FIGS. 11 to 14 a description will be given of the case where the No. 2 car moves to the service floor of the No. 1 car.

FIGS. 11 to 14 are diagrams to explain changes in the screen of the monitor occurring when the elevator monitoring device in Embodiment 1 of the present invention is used.

Figure 11:
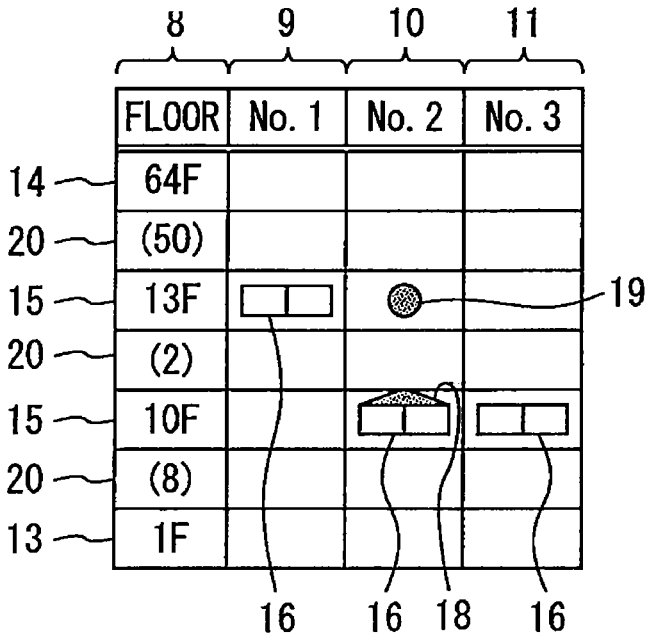
FIG. 11 is a diagram to explain changes in a monitor screen occurring when the elevator monitoring device in Embodiment 1 of the present invention is used.

In FIG. 11, the No. 1 car is present at the 13rd floor. In contrast to this, the No. 2 and No. 3 cars are present at the 10th floor. A consideration will be given to the case where in this state the No. 2 car responds to a car call to the service floor of the No. 1 car. In this case, between the bottom floor and the floor at which the No. 2 and No. 3 cars are present, 8 floors of the 2nd floor to the 9th floor are present. For this reason, "(8)" is indicated in the intermediate-floor indication area 20 between "1F" and "10F."

And 2 floors of the 11th floor and the 12th floor are present between the floor at which the No. 1 car is present and the floor at which the No. 2 and No. 3 cars are present. For this reason, "(2)" is indicated in the intermediate-floor indication area 20 between "10F" and "13F." Between the floor at which the No. 1 car is present and the top floor, 50 floors of the 14th floor to the 63rd floor are present. For this reason, "(50)" is indicated in the intermediate-floor indication area 20 between "13F" and "64F."

Figure 12:
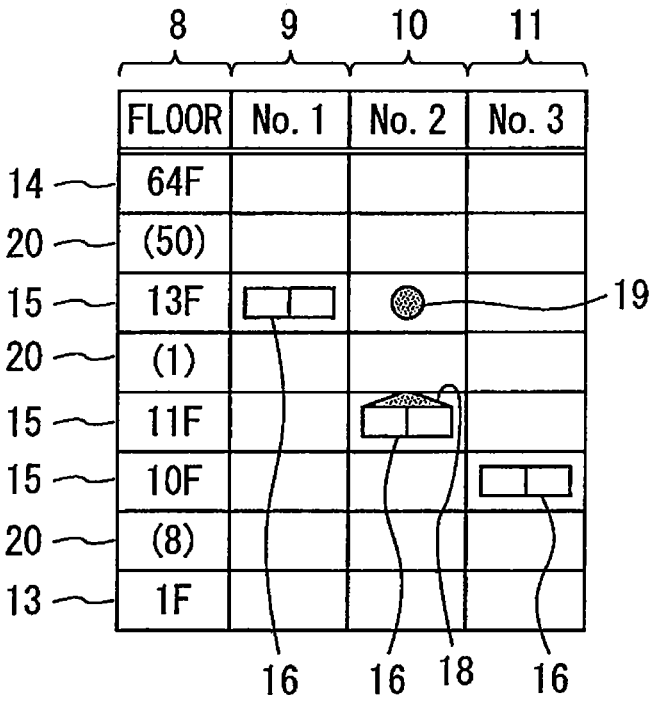
FIG. 12 is a diagram to explain changes in a monitor screen occurring when the elevator monitoring device in Embodiment 1 of the present invention is used.

After that, as shown in FIG. 12, when the No. 2 car ascends to the 11th floor, one area is assigned just above "10F." In this area, "11F" is indicated. The car symbol 16 representing the No. 2 car is indicated in the horizontal direction of this "11F" and below "No. 2." At this time, there is no floor between the floor at which the No. 3 car is present and the floor at which the No. 2 car is present. For this reason, the intermediate-floor indication area 20 is not assigned between "10F" and "11F."

On this occasion, the number of floors between the floor at which the No. 2 car is present and the floor at which the No. 1 car is present decreases from 2 to 1. For this reason, the indication of the intermediate-floor indication area 20 between "11F" and "13F" changes from "(2)" to "(1)."

Figure 13:
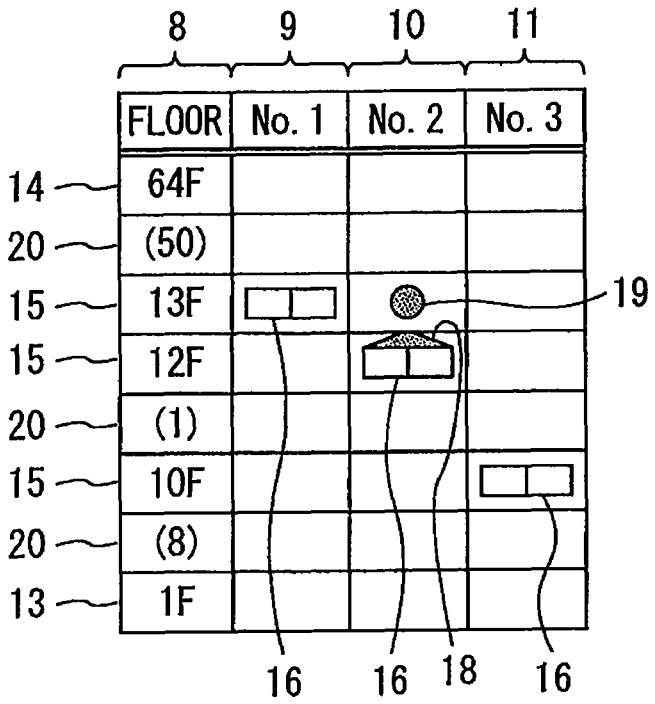
FIG. 13 is a diagram to explain changes in a monitor screen occurring when the elevator monitoring device in Embodiment 1 of the present invention is used.

After that, as shown in FIG. 13, when the No. 2 ascends to the 12th floor, the car-present-floor symbol 15 below the floor indication area 8 and in the horizontal direction of the car symbol 16 representing the No. 2 car changes from "11F" to "12F." At this time, there is no floor between the floor at which the No. 2 car is present and the floor at which the No. 1 car is present. For this reason, the intermediate-floor indication area 20 is erased from between "11F" and "12F."

In contrast to this, one floor of the 11th floor is present between the floor at which the No. 3 car is present and the floor at which the No. 2 car is present. For this reason, an intermediate-floor indication area 20 is assigned between "10F" and "12F." In this intermediate-floor indication area 20, "(1)" is indicated.

Figure 14:
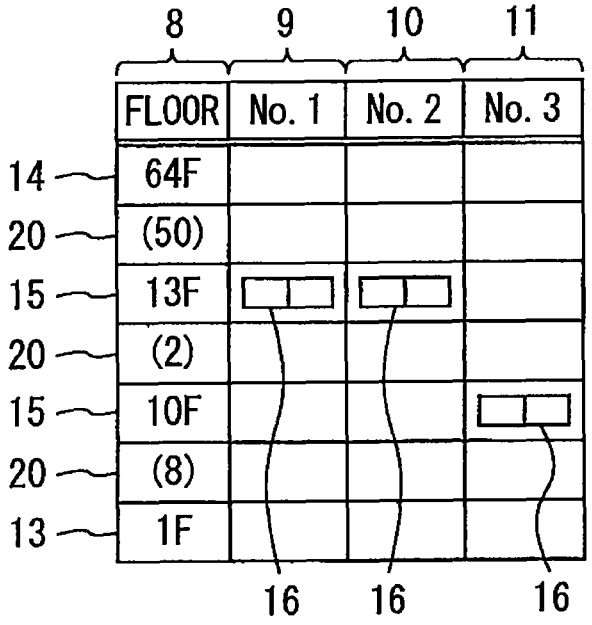
FIG. 14 is a diagram to explain changes in a monitor screen occurring when the elevator monitoring device in Embodiment 1 of the present invention is used.

After that, as shown in FIG. 14, when the No. 2 car arrives at the 13th floor, the floor at which the No. 1 car is present and the floor at which the No. 2 car is present coincide with each other. For this reason, the floor at which the No. 1 car is present and the floor at which the No. 2 car is present are indicated as "13F" in one area.

On this occasion, the number of floors between the floor at which No. 3 cars is present and the floor at which the No. 2 car is present increases from 1 to 2. For this reason, the indication of the intermediate-floor indication area 20 between "10F" and "13F" changes from "(1)" to "(2)."

According to Embodiment 1 described above, intermediate-floor indication areas 20 are assigned between a plurality of car-present-floor symbols 15. These intermediate-floor indication areas 20 are compressed in the direction of arrangement of the plurality of car-present-floor symbols 15 compared to the case where a plurality of symbols representing each of inter-floor floors corresponding to the position of each car are indicated in line. For this reason, it is possible to grasp the positional relationship of elevator cars without indicating the whole shaft screen in a scaled-down manner or indicating a shaft screen in a scrolled manner.

Furthermore, intermediate-floor indication areas 20 are also assigned between a car-present-floor symbol 15 corresponding to a car nearest to the terminal floor side and terminal-floor symbols 13, 14. These intermediate-floor indication areas 20 are compressed compared to the case where a plurality of symbols representing each of floors between a floor corresponding to a car nearest to the terminal floor side and a terminal floor are indicated in line. For this reason, it is possible to reduce the height of a shaft screen while grasping the relative position of cars to a building in which an elevator is installed.

Furthermore, the indication of the car-present-floor symbol 15, the indication of the car symbol 16, and the intermediate-floor indication area 20 change according to changes in the car position. For this reason, even during the operation of an elevator, it is possible to grasp the positional relationship of the cars of the elevator.

In addition, when a car call occurs to the floor to which an intermediate-floor indication area 20 is assigned, the car call symbol 19 is indicated by being correlated to the intermediate-floor indication area 20. For this reason, it is possible to more positively grasp the operation status of an elevator.

Also, the number of assigned floors is indicated in the intermediate-floor indication area 20. For this reason, it is possible to more positively grasp the relative position of cars.

Incidentally, it is not always necessary that in an intermediate-floor indication area 20, the number of floors to which the intermediate-floor indication area 20 is assigned be indicated. Even in this case, it is possible to grasp the positional relationship between the elevator cars.

Embodiment 2

Figure 15:
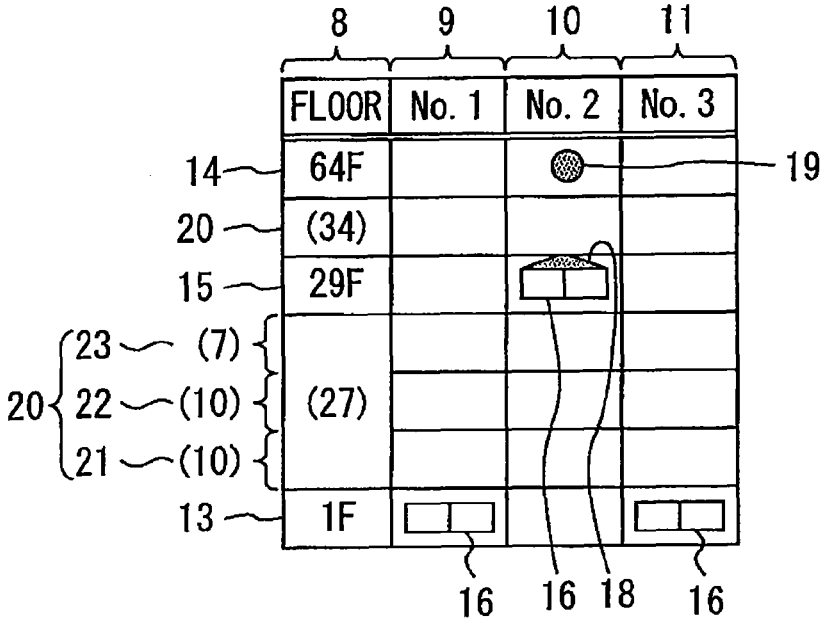
FIG. 15 is a diagram to explain the indication of the monitor expected when an elevator monitoring device in Embodiment 2 of the present invention is used.
Figure 16:
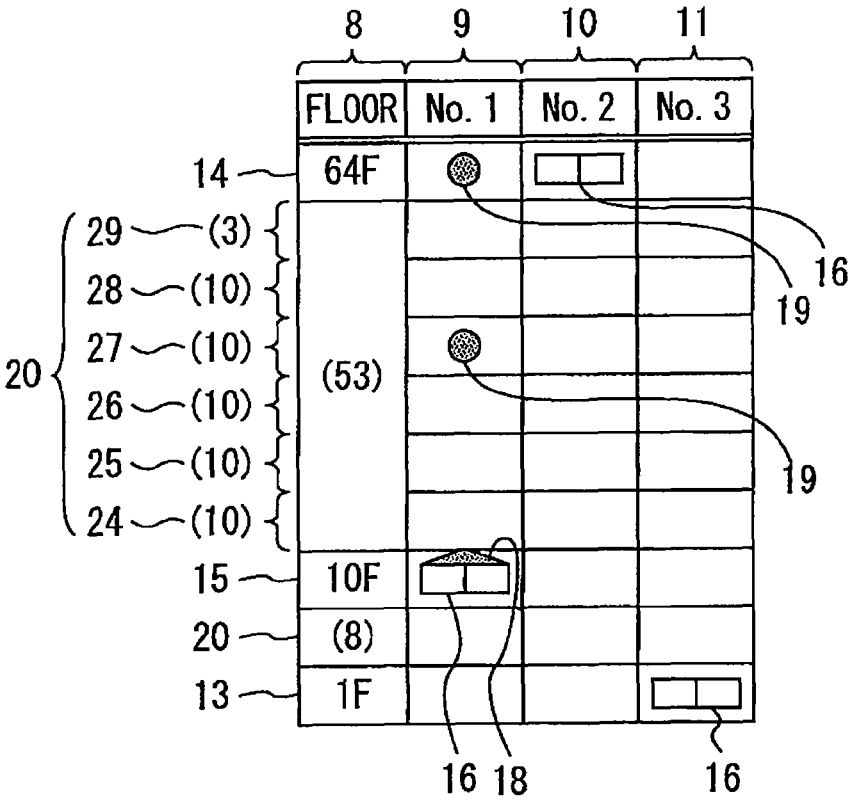
FIG. 16 is a diagram to explain the indication of the monitor expected when an elevator monitoring device in Embodiment 2 of the present invention is used.

FIGS. 15 and 16 are diagrams to explain the indication of the monitor expected when an elevator monitoring device in Embodiment 2 of the present invention is used. Incidentally, parts which are the same as in Embodiment 1 or corresponding parts bear the same numerals and descriptions of these parts are omitted.

In Embodiment 1, one area is assigned as an intermediate-floor indication area 20 between car-present-floor symbols 15 regardless of the number of assigned floors. On the other hand, in Embodiment 2, in an intermediate-floor indication area 20 between car-present-floor symbols 15, one area is assigned to each divided group which is obtained by dividing assigned floors into groups of floors by a prescribed number of floors.

Specifically, floors to which an intermediate-floor indication area 20 is assigned are divided into groups of 10 floors, and one area is assigned to each group of 10 floors. These areas are aggregated in terms of indication. In the middle of this aggregated area, the number of floors assigned to the intermediate-floor indication area 20 is indicated.

In FIG. 15, there are 27 floors of the 2nd floor to the 28th floor between the floor at which No. 1 and No. 3 cars are present and the floor at which the No. 2 car is present. For this reason, one area 21, 22 is assigned to each of the groups of the 2nd floor to the 11th floor, and the 12th floor to the 21st floor. Furthermore, one area 23 is assigned to the remaining group of the 22nd floor to the 28th floor.

In contrast to this, in FIG. 16, there are 53 floors of the 11th floor to the 63rd floor between the floor at which No. 1 car is present and the floor at which the No. 2 car is present. For this reason, one area 24 to 28 is assigned to each of the groups of the 11th floor to the 20th floor, the 21st floor to the 30th floor, the 31st floor to the 40th floor, the 41st floor to the 50th floor, and the 51st floor to the 60th floor. Furthermore, one area 29 is assigned to the remaining group of the 61st floor to the 63rd floor.

In this embodiment, in the case where a car call occurs to a floor corresponding to a divided area, a car call symbol 19 is indicated in an area in the horizontal direction of the divided area and below each of the elevator name indication areas 9 to 11.

For example, when in FIG. 16 a car call from the 45th floor occurs to the No. 1 elevator, a car call symbol 19 is indicated in an area in the horizontal direction of an area 27 to which the 41st floor to the 50th floor are assigned and below the No. 1 elevator name indication area 9.

According to Embodiment 2 described above, an area obtained by dividing the intermediate-floor indication area 20 is assigned to each group obtained by dividing the floors assigned to the intermediate-floor indication area 20 into groups by a prescribed number of floors. For this reason, it is possible to more positively grasp the relative position of each car.

Embodiment 3

FIGS. 17 to 20 are each diagrams to explain changes in the screen of the monitor occurring when an elevator monitoring device in Embodiment 3 of the present invention is used. Incidentally, parts which are the same as in Embodiment 1 or corresponding parts bear like numerals and descriptions of these parts are omitted.

In Embodiment 1, intermediate-floor indication areas 20 are formed in order to represent an inter-floor floor corresponding to the position of each car and the like. On the other hand, in Embodiment 3, no intermediate-floor indication area 20 is formed. Changes in the screen of the monitor 3 in Embodiment 3 will be described concretely below.

Figure 17:
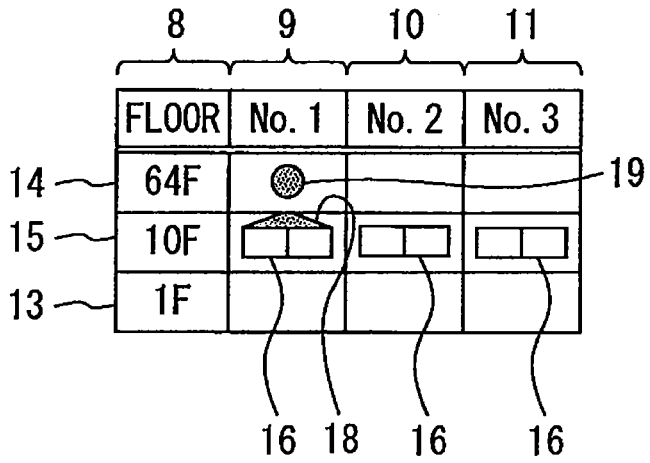
FIG. 17 is a diagram to explain changes in a monitor screen occurring when the elevator monitoring device in Embodiment 3 of the present invention is used.

In FIG. 17, all of the No. 1 to No. 3 cars are present at the 10th floor. A consideration will be given to the case where in this state the No. 1 car responds to a car call from the 64th floor. In this case, unlike Embodiment 1, no intermediate-floor indication area 20 is formed between "1F" and "10F." No intermediate-floor indication area 20 is formed between "10F" and "64F," either.

Figure 18:
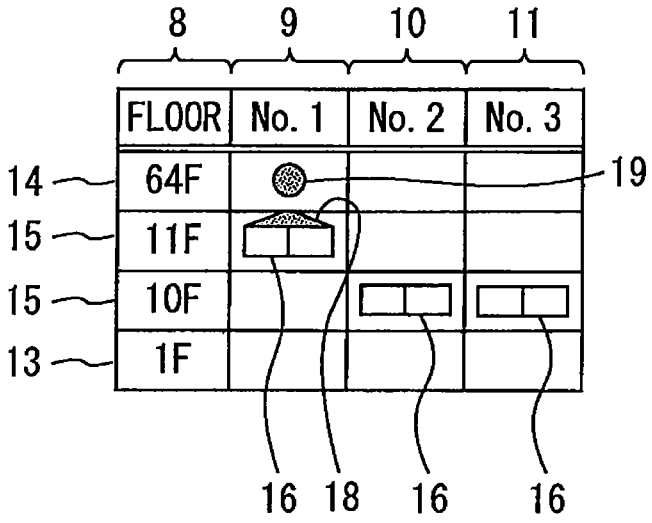
FIG. 18 is a diagram to explain changes in a monitor screen occurring when the elevator monitoring device in Embodiment 3 of the present invention is used.

After that, as shown in FIG. 18, when the No. 1 car ascends to the 11th floor, one area is assigned just above "10F" and just below "64F." In this area "11F" is indicated. The car symbol 16 representing the No. 1 car is indicated in the horizontal direction of this "11F" and below "No. 1."

Figure 19:
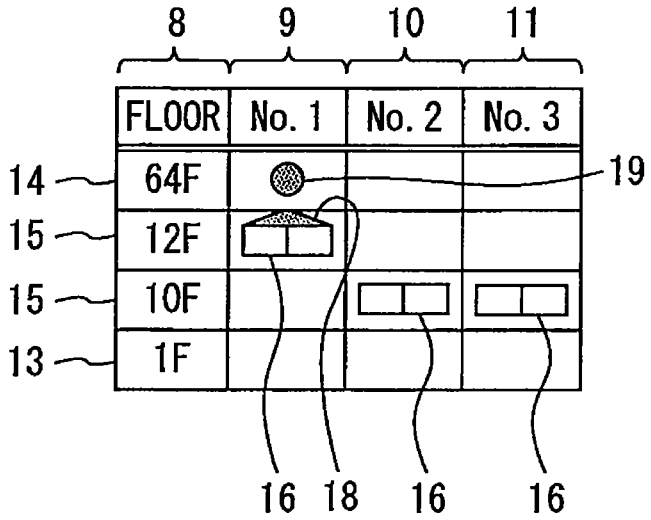
FIG. 19 is a diagram to explain changes in a monitor screen occurring when the elevator monitoring device in Embodiment 3 of the present invention is used.

After that, as shown in FIG. 19, when the No. 1 car ascends to the 12th floor, the car-present-floor symbol 15 below the floor indication area 8 and in the horizontal direction of the car symbol 16 representing the No. 1 car changes from "11F" to "12F." At this time, one floor of the 11th floor is present between the floor at which the No. 2 car and the No. 3 car are present and the floor at which the No. 1 car is present.

However, in this embodiment, no intermediate-floor indication area 20 is formed between "10F" and "12F."

After that, each time the No. 1 car ascends by one floor, the car-present-floor symbol 15 below the floor indication area 8 and in the horizontal direction of the car symbol 16 representing the No. 1 car changes to a symbol representing a corresponding floor.

Figure 20:
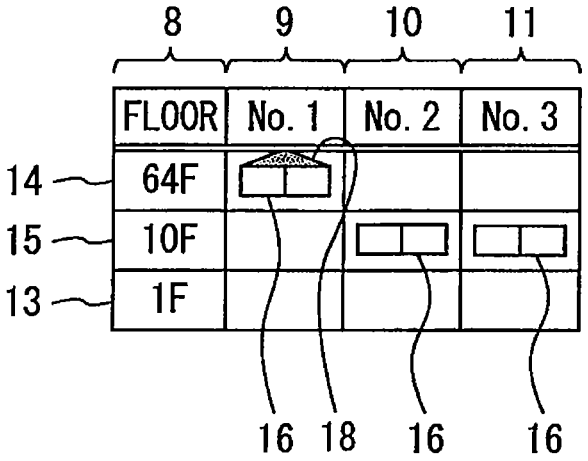
FIG. 20 is a diagram to explain changes in a monitor screen occurring when the elevator monitoring device in Embodiment 3 of the present invention is used.

After that, as shown in FIG. 20, when the No. 1 car arrives at the 64th floor, the floor at which the No. 1 car is present and the top floor coincide with each other. For this reason, the floor at which the No. 1 car is present and the top floor are indicated as "64F" in one area.

According to Embodiment 3 described above, the intermediate-floor indication areas 20 formed in Embodiments 1 an 2 are erased. For this reason, it is possible to reduce the height of the shaft screen to a greater extent than in Embodiments 1 and 2.

INDUSTRIAL APPLICABILITY

As described above, an elevator monitoring device of the present invention can be used in an elevator which enables the positional relationship of cars to be grasped.

DESCRIPTION OF SYMBOLS

1 elevator controller
2 elevator monitoring device

3 monitor
4 elevator status data receiving section
5 memory section
6 monitoring screen data creation section
7 monitoring screen data output section
8 floor indication area
9 to 11 elevator name indication area
12 matrix area
13 to 14 terminal-floor symbol
15 car-present-floor symbol
16 to 17 car-present-floor symbol
18 travel direction symbol
19 car call symbol
20 intermediate-floor indication area
21 to 29 area

The invention claimed is:

1. An elevator monitoring device comprising:

a receiving section which receives position information of each car of an elevator; and an indication control section which causes a plurality of car-present-floor symbols representing floors corresponding to positions of each of the cars to be indicated in line in an order corresponding to a positional relationship of the cars and causes car symbols representing each of the cars to be indicated by being correlated to each of the car-present-floor symbols, wherein the indication control section compresses indication areas which are assigned to inter-floor floors corresponding to the positions of each of the cars between the plurality of car-present-floor symbols, in a direction of arrangement of the plurality of car-present-floor symbols compared to the case where a plurality of symbols representing each of the inter-floor floors corresponding to positions of each of the cars are indicated in line.

2. The elevator monitoring device according to claim 1, wherein the indication control section causes the plurality of car-present-floor symbols to be indicated between terminal-floor symbols each representing a terminal floor, wherein indication areas which are assigned between a car-present-floor symbol representing a floor corresponding to a car nearest to the terminal floor side with respect to a floor between a floor corresponding to the car nearest to the terminal floor side and the terminal floor, are compressed in the direction of arrangement compared to the case where a plurality of symbols representing each of floors between a floor corresponding to the car nearest to the terminal floor side and the terminal floor are indicated in a line.

3. The elevator monitoring device according to claim 1, wherein the indication control section changes the indication of the car-present-floor symbol, the indication of the car symbol, and the indication area according to changes in the car position.

4. The elevator monitoring device according to claim 1, wherein when a car call occurs for the floor to which the indication area is assigned, the indication control section causes the car call symbol to be indicated by being correlated to the indication area.

5. The elevator monitoring device according to claim 1, wherein the indication control section causes symbols representing the number of floors to which the indication area is assigned to be indicated in the indication area.

6. The elevator monitoring device according to claim 1, wherein the indication control section assigns a divided indication area to each of groups of floors to which the indication area is assigned, the floors being divided into groups by a prescribed number of floors.

7. The elevator monitoring device according to claim 1, wherein the indication control section erases the indication area.

* * * * *